United States Patent [19]

Rustin, Jr. et al.

[11] 4,129,246

[45] Dec. 12, 1978

[54] SHIPPING CARTON

[75] Inventors: Rudolph B. Rustin, Jr., Wilson's Mills; O. Sherman Bales, Smithfield, both of N.C.

[73] Assignee: Overton Company, Kenly, N.C.

[21] Appl. No.: 846,342

[22] Filed: Oct. 28, 1977

[51] Int. Cl.[2] ..... B65D 13/00

[52] U.S. Cl. ..... 229/23 R

[58] Field of Search ..... 229/23 R

[56] References Cited

U.S. PATENT DOCUMENTS

| | | | |
|---|---|---|---|
| 3,132,792 | 5/1964 | Minion | 229/23 R |
| 3,187,975 | 6/1965 | Rose | 229/23 R X |
| 3,236,437 | 2/1966 | Johnson | 229/23 R X |
| 3,357,628 | 12/1967 | Fish | 229/23 R |
| 3,443,737 | 5/1969 | Kupensmit | 229/23 R |
| 3,650,459 | 3/1972 | Tucker | 229/23 R X |
| 3,666,164 | 5/1972 | Nederveld | 229/23 R |

*Primary Examiner*—Davis T. Moorhead

*Attorney, Agent, or Firm*—Finnegan, Henderson, Farabow & Garrett

[57] ABSTRACT

A regular hexahedron shipping carton formed by six panels having access to the carton by at least one of the panels. Four of the panels form a regular hexahedron with open sides with at least one of the four panels having an unattached end forming the access panel. Two side panels close the open sides and include integral folding flaps at the perimeter thereof for engaging the adjacent surfaces of the four panels with at least one of the folding flaps having a tucking flap for releasably securing the access panel. The tucking flap is an extension on a folding flap overlying the access panel and sandwiched between tab extensions on the adjacent folding flaps and the access panel.

12 Claims, 8 Drawing Figures

Fig. 3
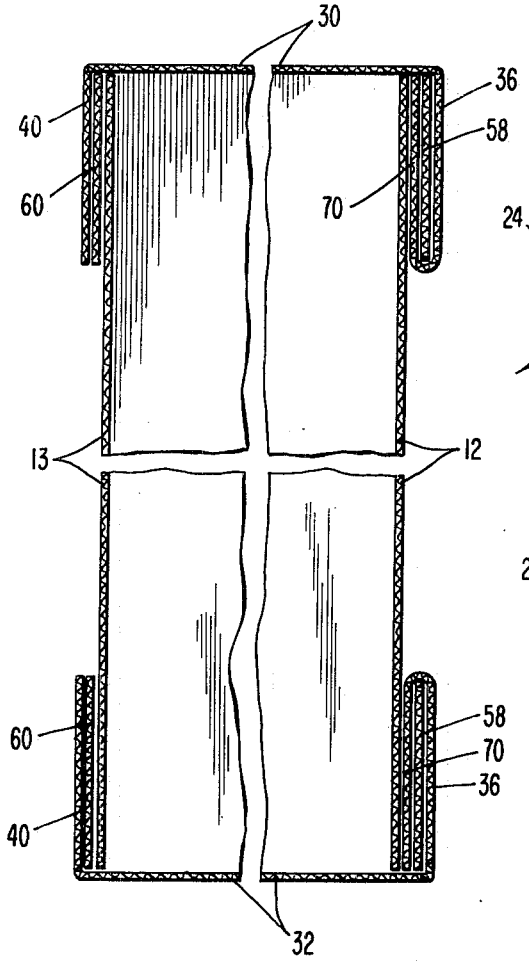
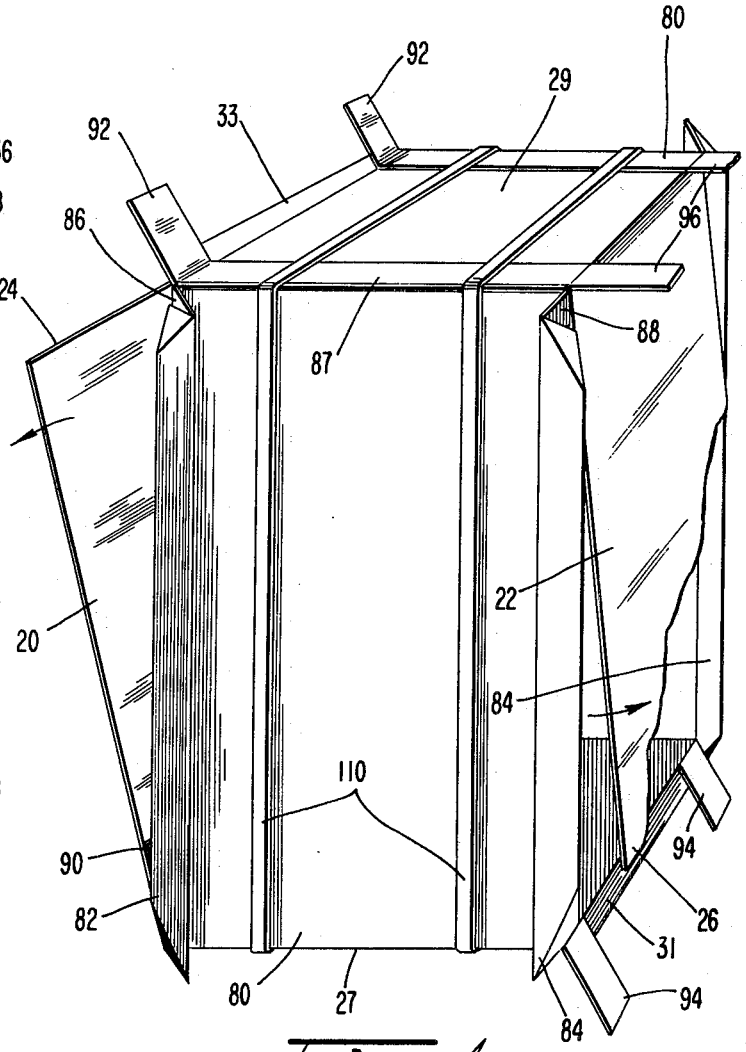
Fig. 4
Fig. 5
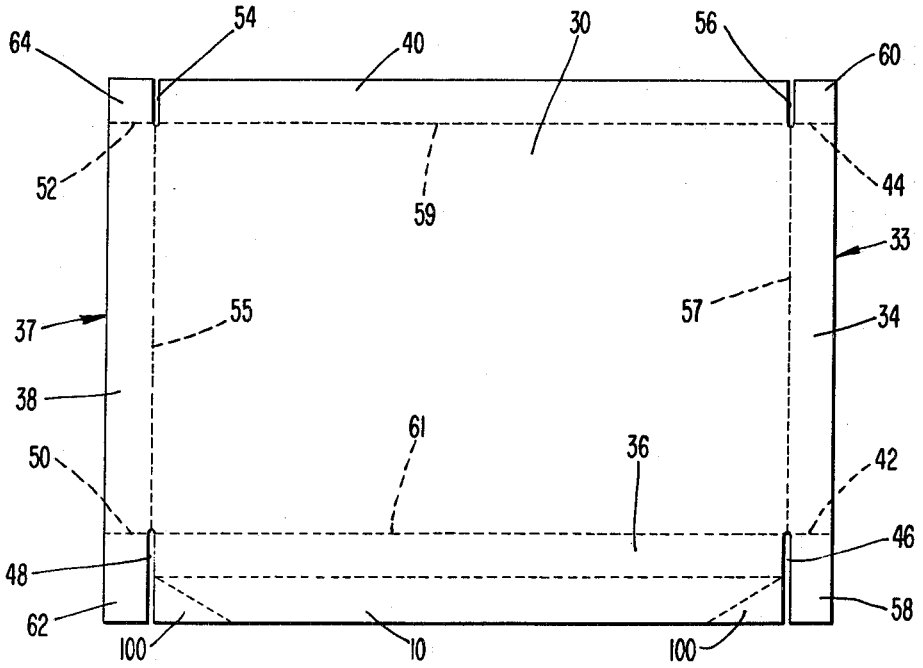

Fig. 6
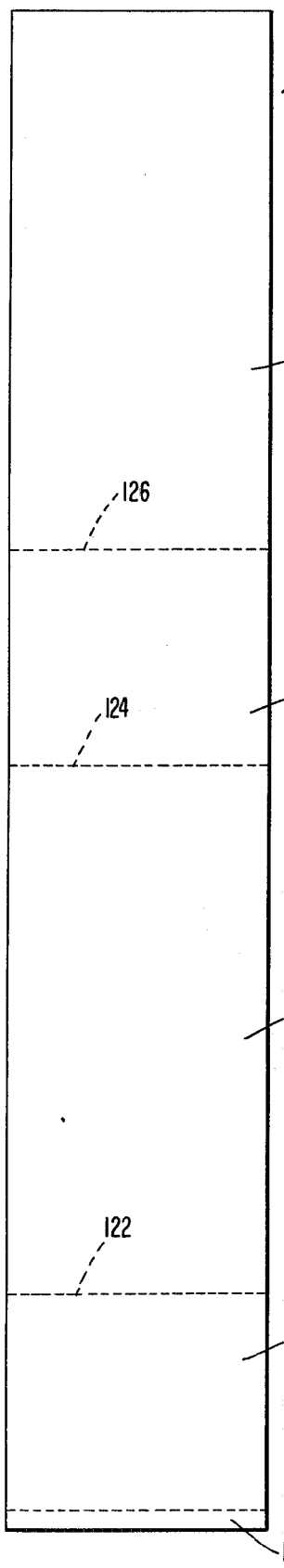
Fig. 7
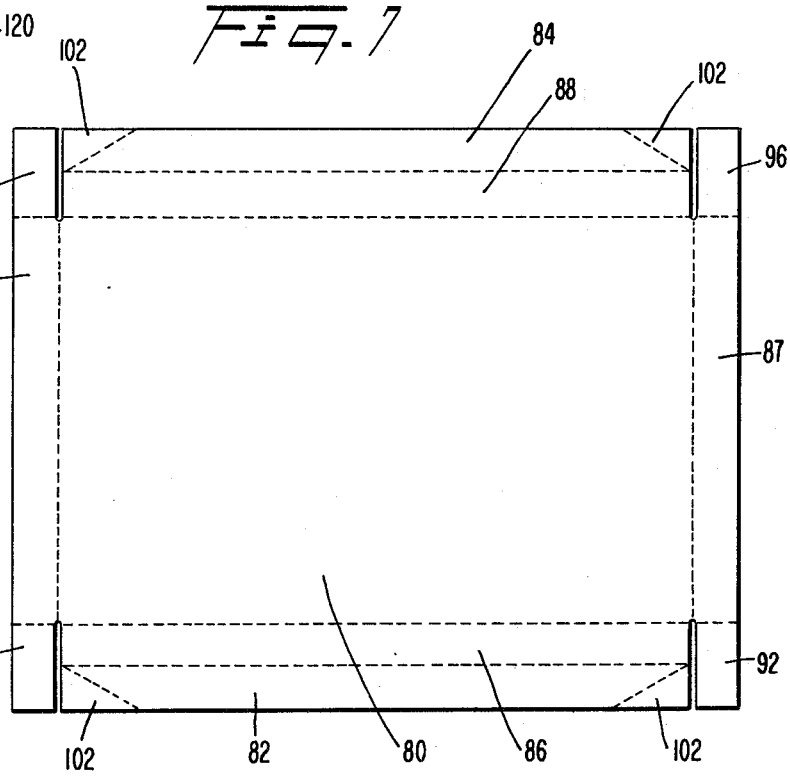
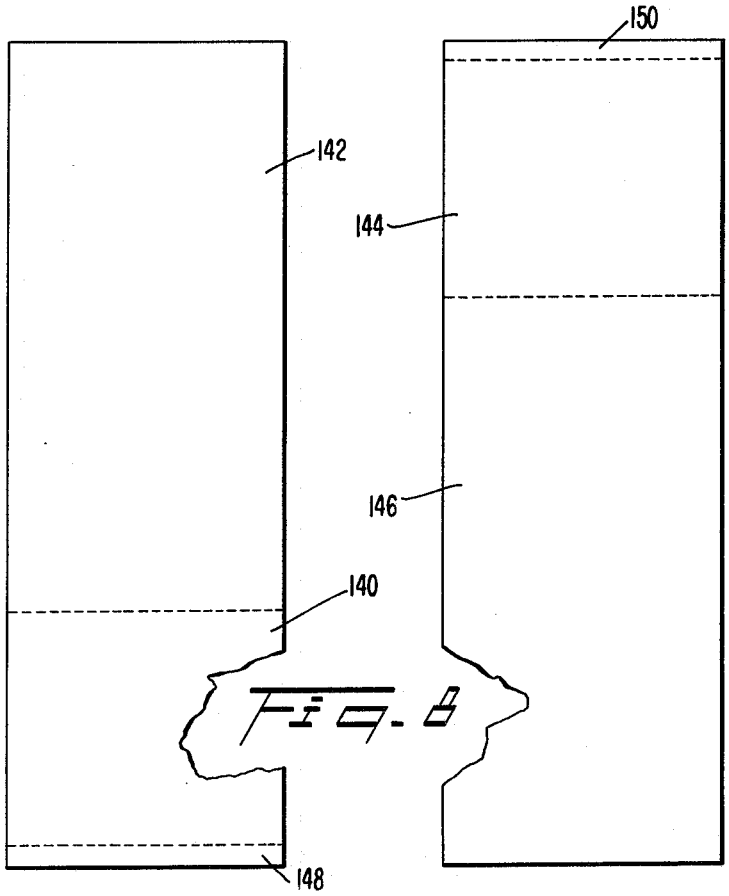
Fig. 8

SHIPPING CARTON

BACKGROUND OF THE INVENTION

1. Field of the Invention

This invention relates to shipping cartons. More particularly, it relates to shipping cartons having means for access to one complete side of the carton permitting opening and reclosing the carton after assembly around its contents.

2. Description of the Prior Art

The shipping carton of this invention is particularly well suited for storage and shipping of kitchen cabinets or other similar items that may be stored in incomplete condition and completed per order just prior to shipping. Many products have a basic structure which is common to all the products of the same size but have one part which varies between products depending on the style or design choice of particular customers. In kitchen cabinets, for example, cabinets of the same size have the same basic structure except for the door which varies depending on the style choice of the customer.

Prior to this invention, kitchen cabinets were fully assembled, placed in shipping cartons and stored awaiting orders from customers. Due to the various door styles available, multiple stocks of the various style kitchen cabinets had to be assembled, placed in cartons and stored. This required a vast amount of storage space, significantly greater production of the basic structure components in order to have an adequate stock of cabinets having each different door style, and prediction of demand for particular styles which, if inaccurate, required additional labor to unpack and change the door on cabinets having less popular styles to meet demand for more popular styles.

The shipping carton of this invention overcomes the previous disadvantages by permitting manufacturing, placing in cartons and storing the basic structural element of the cabinets without attachment of the door. On receiving an order for a particular style cabinet, the door which establishes the style of the cabinet can be installed on the basic structural element without removing it from the carton of this invention. By using this invention, only one stock of the basic structural element for each size of cabinet need be maintained. Thus, required storage space is greatly reduced since the individual style doors can be stored separately from the basic structural elements.

Furthermore, since a cabinet is not assembled with an individual style door until an order is received, an incorrect prediction of style demands does not leave one stock of assembled cabinets virtually unsold or require the additional labor to unpackage and change the doors on already packaged cabinets.

This invention greatly reduces the costs involved in labor, inventory and warehouse facilities previously required in kitchen cabinet industries and other industries manufacturing products having various style, interchangeable components.

SUMMARY OF THE INVENTION

In accordance with the purpose of the invention, as embodied and broadly described herein, the regular hexahedron shipping carton formed of six panels and having a means for access to the carton by at least one of the panels, comprises four panels forming a regular hexahedron with open sides, one of the four panels having one unattached end forming an access panel;

two side panels for closing the open side; and means integral with each side panel at the perimeter thereof for engaging the adjacent surfaces of the four panels, the engaging means including a tucking means for releasably securing the access panel.

Preferably, the engaging means integral with each side panel comprises a flap foldably attached to each edge of the side panel, each flap having a pair of opposed ends forming a common edge with the adjacent edges of the side panel and being folded 90° to the side panel and respectively adjacent to one of the four panels; and a tab means on selected ones of said opposed ends for restraining the flaps in the folded position.

It is also preferred that the tab means include elongated tabs on the corresponding end of the side flaps adjacent to flaps contiguous with the access panel and that the tucking means comprise extension means on the flaps contiguous with the access panel for folding over the elongated tabs and for sandwiching the ends of the extensions between the elongated tabs and the access panel.

It is also preferred that a triangular flap means be formed at each end of the extension means for relieving resistance to the sandwiching of the extension means between the elongated tabs and the access panel and to the removal of the extension means from between the elongated tabs and the access panel.

It may also be preferred to include a means for securing the side panels to at least two of the four panels enclosing the open sides of the hexahedron and leaving free the access panel.

Also in accordance with the invention, a blank for forming a regular hexahedron shipping carton having means for access to said carton through at least one side of the carton is provided comprising a rectangular sleeve blank laterally sectioned into four panels forming the top, back, bottom and front panels of the carton, at least one of the panels having an unconnected edge; and a pair of side cover blanks each comprising a rectangular side panel substantially co-extensive with the area defined by the side edges of the sleeve blank, when folded to form the regular hexahedron carton, the side panel having a pair of opposed end edges and a pair of opposed side edges; a pair of rectangular end flaps, each having a middle section and a pair of end sections, each of the end sections being foldably attached to an individual end of the middle section, and the middle section of each end flap having a length substantially equal to one end edge of the side panel, the middle section of a respective one of the pair of end flaps being foldably attached on a fold line to a respective one of the end edges; a pair of rectangular side flaps, each having a length substantially equal to one side edge of the side panel and a respective one of the pair of side flaps being foldably attached on a fold line to a respective one of the side edges; and an extension flap foldably attached at one side edge on a fold line to the side remote from the side panel of at least one of the side flaps and having a length substantially equal to the side flap.

Preferably, a triangular flap is formed at each end of each extension flap by a fold line.

It may also be preferred that the sleeve blank be in two pieces, each being foldably divided into two panels, one forming the top and back panels of the carton and the other forming the bottom and front panels of the carton, and wherein each of the panels has one unconnected end edge. In such an embodiment, it is preferred that each side flap also include an extension flap attached thereto.

The invention is intended to provide a carton for the storage and shipping of products and to facilitate access to the contents of the carton without having to disassemble the carton.

The invention is intended to provide the means for prepackaging products that are complete but for components that vary depending upon the style and a means for installing those style components onto the products within the carton without removing the product from the carton.

The invention also provides a carton which may be opened for access to the contents and reclosed for shipping without the necessity for additional means of securing the carton in a closed condition.

Additional advantages of the invention will be set forth in part in the description which follows, and in part will be obvious from the description, or may be learned by practice of the invention. The accompanying drawings, which are incorporated in and constitute a part of this Specification, illustrate one embodiment of the invention and, together with the description, serve to explain the principles of the invention.

BRIEF DESCRIPTION OF THE DRAWINGS

FIG. 3 is a cross-sectional view of one end of the shipping carton of FIG. 1.

FIG. 4 is a perspective view of another embodiment of the shipping carton of this invention having two access panels, both partially open.

FIG. 5 is a top plan view of the blank for one of the side panels of the carton of FIG. 2.

FIG. 6 is a top plan view of the four-panel sleeve blank of the carton of FIG. 2.

FIG. 7 is a top plan view of the blank for one of the side panels of the carton of FIG. 4.

FIG. 8 is a top plan view of the two-piece sleeve blank of the carton in FIG. 4.

DESCRIPTION OF THE PREFERRED EMBODIMENTS

Reference will now be made in detail to the present preferred embodiments of the invention, examples of which are illustrated in the accompanying drawings.

In accordance with the invention, the regular hexahedron shipping carton includes four panels forming a regular hexahedron with open sides, at least one of the panels having one unattached end forming an access panel.

Figure 1:
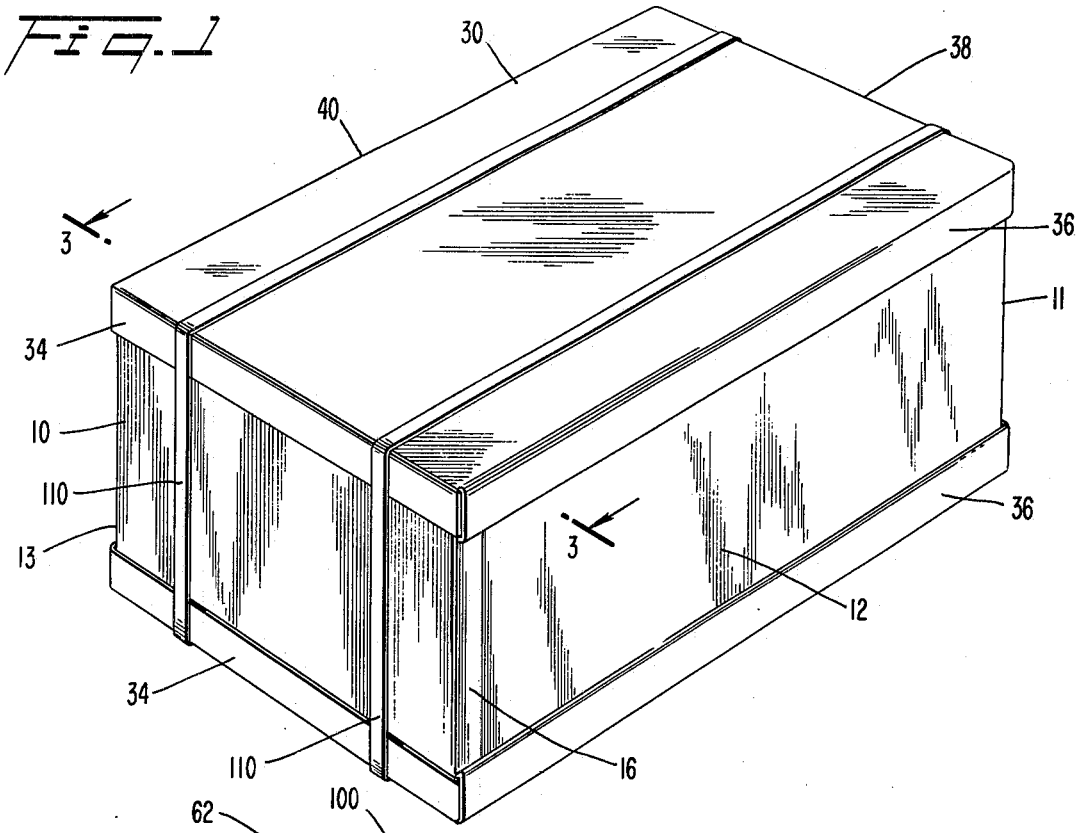
FIG. 1 is a perspective view of the assembled shipping carton of this invention.
Figure 2:
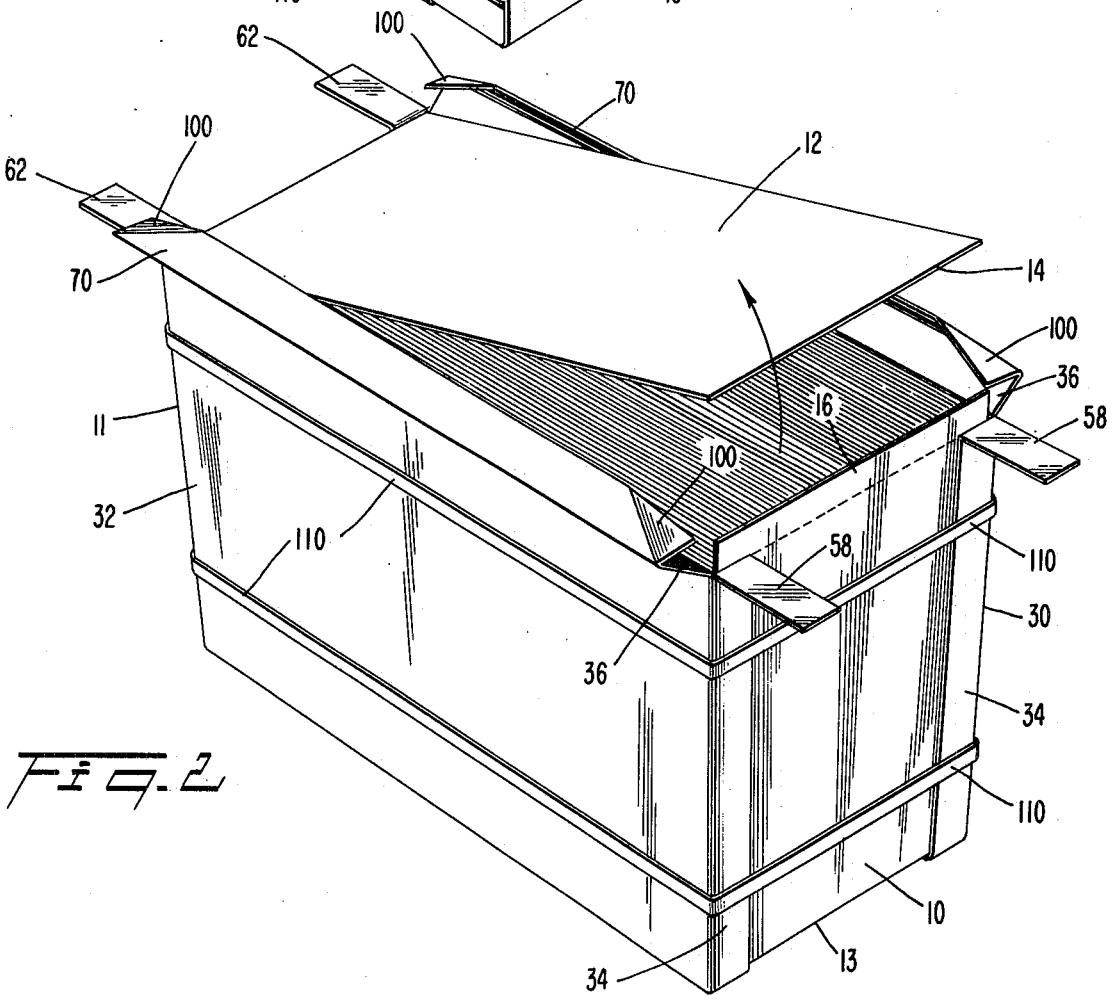
FIG. 2 is a perspective view of the shipping carton of FIG. 1 with the access panel partially open.

As here embodied and depicted in FIGS. 1 and 2, the shipping carton has a top panel 10, a front panel 12, bottom panel 11 and back panel 13 forming a regular hexahedron with open sides. The front panel 12 has an unattached end 14 forming the access panel.

Preferably, the end of the panel 10 adjacent the front panel 12 has a dust flap 16 foldably attached thereto. The dust flap 16 may be located inside or outside the front panel 12 when the carton is closed.

In another embodiment, as seen in FIG. 4, the front panel 20 and the back panel 22 each has an unattached end 24 and 26, respectively, forming two access panels. In this embodiment, the unconnected end of the bottom panel 27 and the unconnected end of the top panel 29 each has a dust flap, 31 and 33, respectively, foldably attached thereto.

In accordance with the invention, two side panels 30 and 32, as seen in FIGS. 1 and 2, are provided for enclosing the open sides of the hexahedron formed by the top, bottom, front and back panels 10, 11, 12 and 13.

Also in accordance with the invention, each side panel has means integral therewith at its perimeter for engaging the adjacent surfaces of the top, front, back and bottom panels.

Preferably, as herein embodied and illustrated in FIGS. 1, 2 and 3, the engaging means integral with each side panel 30 and 32 comprises four flaps 34, 36, 38, 40, a respective one being foldably attached to each edge of the side panel 30 and 32. As best seen in FIG. 5, each flap 34, 36, 38, 40 has a pair of opposed ends (42, 44), (46, 48), (50, 52), (54, 56), respectively, each end forming a common edge with the adjacent edge of the side panel.

As depicted in FIG. 1, each flap 34, 36, 38, 40 is folded 90° to the side panel and is respectively adjacent one of the top 10, front 12, back 13 or bottom 11 panels.

It is preferred that tab means be foldably attached to selected ones of the opposed ends of the flaps for restraining the flaps in the folded position.

In the preferred embodiment, as seen in FIG. 5, the tabs 58, 60, 62 and 64 are foldably attached to flap ends 42, 44, 50 and 52, respectively. To restrain the flaps 34, 36, 38 and 40 in the folded position, the tabs 58, 60, 62 and 64 are folded 90° to their respective flaps 34 and 38 and are secured to the inside contiguous surfaces of the adjacent folded flaps 36 and 40.

In accordance with the invention, the engaging means includes a tucking means for releasably securing the access panel. Preferably the tucking means comprises an extension means on one or more flaps contiguous with the access panel. The extension means is folded over the tabs contiguous with the flaps having the extension means and sandwiched between the tabs and the access panel.

As here embodied, the tucking means comprises an extension flap 70 foldably attached to the edge remote from the side panel of at least one flap 36 on each side panel 30, 32. As seen in FIG. 2, the extension flap 70 is foldably attached to one side of flap 36 on each side panel 30 and 32. To releasably secure the access panel, front panel 12 in the embodiment depicted in FIGS. 2 and 3, the tabs 58 and 62 on each side panel 30, 32 are folded to the position contiguous with the access panel in the closed position and the extension flap 70 on each side panel 30 and 32 is folded over the tabs 58 and 62 and sandwiched between the tabs 58 and 62 and the front panel 12.

Preferably the tabs 58 and 62 over which the extension flap 70 is folded are longer than tabs 60 and 64 not associated with the tucking means.

In another embodiment, as seen in FIGS. 4 and 7, where the front panel 20 and the back panel 22 are both access panels, each side panel 80 has two extension flaps 82, 84, one attached to each of a pair of opposed flaps 86, 88. In this way the two access panels may be releasably secured by the extension flaps 82, 84 being folded over the tabs (90, 92), (94, 96), of each side panel and being sandwiched between the tabs and the access panels. In this embodiment all of the tabs will be substantially the same length.

Preferably, the extension flaps 70, 82 and 84 in each embodiment have a width slightly less than that of the associated flaps 36, 86, 88. This creates a gap between the edge of the extension flap 70, 82, 84 and the edge of the respective side panel 30, 32, 80 in the fully closed carton to permit placement of an instrument or the fingers of a worker's hand underneath the extension flap 70, 82, 84 so that the flap may be unfolded to release the access panel.

To facilitate unfolding and refolding the extension flaps 70, 82, 84 against the access panel, which may be restricted in movement inward due to the contents of the carton, it is preferred that each extension flap 70, 82, 84 include a triangular flap means formed at each end thereof. The triangular flaps 100, 102, as best seen in FIGS. 5 and 7, are formed by fold lines or creases at each end of each extension flap. Each triangular flap 100, 102 is substantially a right triangle with the right angle being the end corner of the extension flap 70, 82, 84 and the fold line being the hypotenuse.

Although the side panels 30, 32, 80 may be secured to the carton by any number of methods including glue or staples attaching the flaps 34, 38, 40 and 87, 89 not adjacent an access panel to the adjacent top, back, bottom or front panels 10, 11, 13 and 27, 29, it is preferred that the means for securing the side panels to at least two of the four panels while leaving free the access panel be binding straps 110. The binding straps 110 are wrapped and secured around the carton after it is assembled around its contents. As seen in FIGS. 1, 2 and 4, the binding straps 110 are secured around the two side panels 30, 32 and two opposite panels 10 and 11 of the four panels forming the open-sided hexahedron. This arrangement permits the other two 12, 13 of the four panels to be access panels.

In accordance with the invention, the blank for forming a regular hexahedron shipping carton having a means for access to the carton through one side, includes a rectangular sleeve blank laterally sectioned into four panels, at least one panel having one unconnected end edge.

As here embodied and seen in FIG. 6, the sleeve blank 120 is laterally sectioned by fold lines 122, 124, 126 forming four interconnected panels 128, 130, 132, 134. Of course, to form a regular hexahedron, panels 128 and 132 and panels 130 and 134 must have substantially the same dimensions. For the sake of description clarity, the first and third panels 128 and 132 will be called the top and bottom panels, and the second and fourth panels 130 and 134 will be called the back and front panels.

The front panel 134 and the top panel 128 each has one unconnected end edge, however, it is preferred to foldably attach a dust flap 136 to the unconnected edge of the top panel 128.

In another embodiment (FIG. 8), the sleeve blank is in two pieces, each piece including two panels. Preferably, one piece has a top panel 140 and a back panel 142 and the other piece has a bottom panel 144 and a front panel 146. Each panel has an unconnected end edge, but, preferably, a dust flap 148, 150 is foldably attached to the unconnected end edge of each of the top and bottom panels 140 and 144, respectively. This embodiment of the sleeve blank is used to form the hexahedron carton having two access panels.

Also, in accordance with the invention, the blank for forming the regular hexahedron carton also includes a pair of side cover blanks. As seen in FIG. 5, each side cover blank comprises a rectangular side panel 30 having an area substantially coextensive with the area defined by the side edges of the sleeve blank when folded to form the regular hexahedron carton. Each side panel has a pair of opposed end edges 55, 57 and a pair of opposed side edges 59, 61.

The side cover blanks also include a pair of rectangular end flaps 33 and 37, each having a middle section 34 and 38, and a pair of tabs 58 and 60, and 62 and 64, respectively, one of the tabs 58, 60, 62 and 64 being foldably attached to each end 42, 44, 50 and 52, respectively, of the middle section 34 and 38. The middle section 34 and 38 of each end flap 33 and 37 has a length subtantially equal to the end edge 55 and 57 of the side panel 30 and is foldably attached on a fold line to a respective one of the end edges 55 and 57 of the side panel 30.

A rectangular side flap 36, 40, having a length substantially equal to one side edge 59, 61 of the side panel 30, is foldably attached on a fold line to each side edge 59, 61 of each side panel 30.

Also included in each side panel blank, in the embodiment of FIG. 5, is an extension flap 70 foldably attached on a fold line to the side remote from the side panel 30 of at least one of the side flaps 36, 40. The extension flap 70 has a length substantially equal to the side flap 36, 40 and a width slightly less than that of the side flap 36, 40.

In another embodiment as seen in FIG. 7, an extension flap 82 and 84 is foldably attached on a fold line to the side remote from the side panel 80 of each of the side flaps 86 and 88. Side panel blanks of this construction are used in conjunction with the two-piece sleeve blank embodiment (FIG. 8) to form a carton having two access panels (FIG. 4).

It is preferred that each extension flap 70, 82 and 84 include a triangular flap 100, 102 formed in each end of each extension flap 70, 82 and 84.

The carton of this invention is simple to assemble and provides easy access to its interior. To simplify explanation of its assembly and use, reference is made to use of the carton for packing, storage and shipment of kitchen cabinets.

The side panel blanks (FIGS. 5 and 7) may be preassembled. The blank of FIG. 5 is assembled by folding end flaps 33 and 37 to a position 90° to one side of the side panel 30, folding the tabs 58, 60, 62 and 64 90° to the middle section 34 and 38 of their respective end flaps 33 and 37 towards the side panel 30, folding the rectangular side flaps 36 and 40 to a position contiguous with the folded tabs 58, 60, 62 and 64, and folding the extension flap 70 over the tabs 58 and 62. The side flap 40 not having the flap extension may be permanently secured to the tabs 60 and 64 by any means such as glue, tape or staples. The extension flap 70 may be temporarily secured in its folded position to the tabs 58 and 62 or to the side flap 36 by any removable means such as tape, a light spot of glue or an easily removable staple. The extension flap 70 is secured in its folded position only to keep the side panel blank in an assembled condition before installation on a carton.

The other embodiment of the side panel blank as seen in FIG. 7 may also be pre-assembled in substantially the same manner except that both side flaps 86, 88 are temporarily secured contiguous the folded tabs 90, 92, 94 and 96 by the extension flaps 82, 84 which are temporarily secured in their folded positions in the same manner as the single extension flap 70 is secured in the other embodiment.

The carton is assembled to enclose a kitchen cabinet without a door by wrapping the sleeve blank around four sides of the cabinet with the access panel placed over the side on which the design door is to be installed. Referring to the sleeve in FIG. 6, the front panel 134 is the access panel and is placed over the front of the cabinet. The dust flap 136 may be placed between the cabinet and the access pane or it may overlap the unconnected edge of the access panel.

Where the kitchen cabinet is of the type having a door opening on two opposite sides, the sleeve blank of FIG. 8 is wrapped around the cabinet with one of the panels 142, 144 being located over each of the door openings forming access panels.

Once the sleeve blank is placed around the cabinet, one assembled side panel blank is placed over each side of the cabinet with the side and end flaps 34, 36, 38 and 40 overlapping the side edges of the panels of the sleeve blank.

Where the cabinet has two door openings and the two-access-panel sleeve blank (FIG. 8) is used, the side panel blanks must be of the type (FIG. 7) having an extension flap 82, 84 foldably attached to each side flap 86, 88. Where the cabinet has only one door opening, the one-access-panel sleeve blank (FIG. 6) may be used and the side panel blanks may be of the type (FIG. 5) having only one extension flap 70.

The two-access-panel sleeve blank (FIG. 8) and the side panel blanks (FIG. 7) having two extension flaps 82, 84 may be used with cabinets having only one door and, therefore, need of only one access panel, and this may be preferable because it eliminates the necessity of manufacturing and maintaining a stock of both types of sleeve and side panel blanks.

No matter which side panel blank is used with which sleeve blank to form a carton, it is necessary that the side panels be placed on the sides of the hexahedron formed by the sleeve such that a side flap having an extension flap foldably attached thereto overlaps each side edge of each access panel.

Securing the side panels to the carton may be accomplished by gluing, stapling or taping the side panel flaps to those sleeve panels that are not intended to be access panels. It is preferable, however, to bind the side panels to the carton by means of one or more straps 110 passing around the side panels and two opposite sleeve panels not including the access panel. As seen in FIGS. 1, 2 and 4, the straps 110 secure the side panels 30, 32 and 80 to the top and bottom panels 10, 11, 27 and 29 thus securing the carton around the cabinet while leaving free the front and back panels 12, 13, 20 and 22, either or both of which may be an access panel.

Once the cabinet without doors is secured within the carton, it may be stored to await a customer order which designates the design of the doors. To prepare the cabinet for shipment, one of the stored cartons must be opened to install the door or doors.

Referring to FIG. 2, to open the carton it is necessary to grip with fingers or an instrument the side edge of both extension flaps 70 and to apply force for releasing the temporary means for securing the extension flap 70 in the folded position and for unfolding the extension flaps 70. Unfolding of the extension flaps 70 will be facilitated by the triangular flaps 100 at the ends of each extension flap 70.

After unfolding the extension flaps 70, the side flaps 36, the tabs 58 and 62, the access panel 12 and the dust flap 16 may be unfolded to give access to the door opening of the cabinet located under the access panel 12.

After installation of the door, the opening steps may be reversed to close the cabinet. After the extension flaps 70 are tucked under the side flaps 36 and sandwiched between the tabs 58 and 62 and the access panel 12, the carton is secure for shipment. No means for securing the extension flaps 70 in the folded position should be necessary as it is intended that the carton be only slightly larger than the cabinet and the clearances be so small as to prevent accidental unfolding of the extension flap 70. Nonetheless, one or more staples or other means of securing the extension flaps 70 in the folded position may be added after the carton has been reclosed.

The procedure for opening and reclosing those cartons enclosing cabinets requiring two doors is the same as for the single access panel carton. The steps must be followed for both access panels 20, 22 as seen in FIG. 4.

Although the terms top, bottom, front, back and sides have been used in the description of this invention, such references were used merely for ease in description and were not intended to limit the various configurations in which this invention may be used.

What is claimed is:

1. A regular hexahedron shipping carton formed by six panels having recloseable means for access to said carton by at least one of said panels, comprising:

(a) four panels forming the regular hexahedron with open sides, at least one of said four panels having one unattached end forming an access panel;

(b) two side panels for closing the open sides; and (c) means integral with each side panel at the perimeter thereof for engaging the adjacent surfaces of said four panels, said engaging means including tucking means for frictionally and releasably securing said access panel and for permitting opening and reclosing said access panel without disassembly of said carton, said engaging and tucking means being the sole means necessary for securing said access panel in closed position.

2. The shipping carton as in claim 1 wherein said engaging means integral with each side panel comprises:

(a) a flap foldably attached to each edge of said side panel, each flap having a pair of opposed ends, said flaps being folded 90° to the side panel and respectively adjacent to one of said four panels, the adjacent ends of the flaps forming a common edge; and (b) tab means foldably attached to selected ones of said opposed ends for restraining said flaps in the folded position.

3. The shipping carton of claim 2 wherein said tab means includes elongated tabs on the corresponding end of said flaps adjacent the flaps contiguous with the access panel and said tucking means comprises extension means on said flaps contiguous with the access panel for folding over the elongated tabs and for sandwiching the extension means between the elongated tabs and the access panel.

4. The shipping carton as in claim 3 also including triangular flap means formed at each end of said extension means for relieving resistance to the sandwiching of said extension means between the elongated tabs and the access panel and to the removal of said extension means from between said elongated tabs and said access panel.

5. The shipping carton as in claim 1 also including means for securing said two side panels to at least two of said four panels for enclosing the open sides of the said hexahedron and leaving free said access panel.

6. A blank for forming a regular hexahedron shipping carton having a means for access to said carton through at least one side of said carton, comprising:

(a) a rectangular sleeve blank laterally sectioned into four panels forming the top, back, bottom and front panels of said carton, at least one of said panels having one unconnected end edge; and (b) a pair of side cover blanks, each comprising:

(1) a rectangular side panel substantially coextensive with the area defined by the side edges of said sleeve blank when folded to form said regular hexahedron carton, said side panel having a pair of opposed end edges and a pair of opposed side edges;

(2) a pair of rectangular end flaps, each having a middle section and a pair of tabs, one of said tabs being foldably attached to each end of said middle section, said middle section of each end flap having a length substantially equal to one end edge of said side panel and the middle section of each one of said pair of end flaps being foldably attached on a fold line to an individual one of said end edges;

(3) a pair of rectangular side flaps each having a length substantially equal to one side edge of said side panel and one of said pair of side flaps being foldably attached on a fold line to an individual one of said side edges; and (4) an extension flap foldably attached at one side edge on a fold line to the side remote from said side panel of at least one of said side flaps and having a length substantially equal to said side flap.

7. The blank as in claim 6 also including a triangular flap formed in each end of each extension flap by a fold line.

8. The blank as in claim 6 wherein said sleeve blank is divided by fold lines into top, back, bottom and front panels in longitudinal series and wherein said front panel and said top panel each has one unconnected end edge.

9. The blank as in claim 8 also including a dust flap foldably attached on a fold line to the unconnected end edge of said top panel.

10. The blank as in claim 6 wherein said sleeve blank is in two pieces, each piece being foldably divided into two panels, one forming the top and back panels of the carton and the other forming the bottom and front panels of the carton, and wherein each of said panels has one unconnected end edge.

11. The blank as in clam 10 also including a dust flap foldably attached on a fold line to the unconnected end edge of each of said top and bottom panels.

12. The blank as in claim 10 wherein each side flap also includes an extension flap attached thereto.

* * * * *